US008966709B2

(12) United States Patent
Coleman et al.

(10) Patent No.: US 8,966,709 B2
(45) Date of Patent: Mar. 3, 2015

(54) CLEANER HEAD FOR A VACUUM CLEANER

(71) Applicant: Dyson Technology Limited, Wiltshire (GB)

(72) Inventors: James Martin Coleman, Malmesbury (GB); Simon Peter Cross, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 13 days.

(21) Appl. No.: 13/964,909

(22) Filed: Aug. 12, 2013

(65) Prior Publication Data

US 2014/0041152 A1 Feb. 13, 2014

(30) Foreign Application Priority Data

Aug. 13, 2012 (GB) ..... 1214420.0

(51) Int. Cl.
*A47L 9/04* (2006.01)

(52) U.S. Cl.
CPC ..... *A47L 9/0416* (2013.01); *A47L 9/0427* (2013.01)
USPC ..... 15/375; 15/387

(58) Field of Classification Search
USPC ..... 15/375, 415.1, 383, 387, 416, 418, 419, 15/421
See application file for complete search history.

(56) References Cited

U.S. PATENT DOCUMENTS 2,648,396 A 8/1953 Kirby
2,904,816 A 9/1959 Skolfield
2,904,817 A 9/1959 Brennan
5,008,973 A 4/1991 Wörwag
5,088,149 A 2/1992 Berg et al.
5,293,665 A 3/1994 Wörwag
5,345,650 A 9/1994 Downham et al.
5,416,948 A 5/1995 Wörwag
5,592,716 A 1/1997 Morén et al.
5,802,666 A 9/1998 Jung (Continued)

FOREIGN PATENT DOCUMENTS

DE 42 29 030 3/1994
DE 195 07 528 9/1996

(Continued)

OTHER PUBLICATIONS

International Search Report and Written Opinion mailed Dec. 4, 2013, directed to International Application No. PCT/GB2013/052114; 9 pages.

(Continued)

*Primary Examiner* — Dung Van Nguyen
(74) *Attorney, Agent, or Firm* — Morrison & Foerster LLP

(57) ABSTRACT

A cleaner head that includes a suction inlet for admitting a first airflow, a turbine inlet for admitting a second airflow, an outlet for discharging the first airflow and the second airflow and an agitator and its drive assembly. A first airflow path then carries the first airflow from the suction inlet to the outlet, and a second airflow path carries the second airflow from the turbine inlet to the outlet. The drive assembly includes a turbine that is driven by the second airflow. A baffle is located in the second airflow path and is movable between an open position in which the second airflow path is unrestricted and a closed position in which the second airflow path is restricted. The baffle is biased in the open position and moves to the closed position when the dynamic pressure of the second airflow at the baffle exceeds a threshold.

18 Claims, 5 Drawing Sheets

(56) References Cited

U.S. PATENT DOCUMENTS

| | | | | |
|---|---|---|---|---|
| 5,950,275 | A | 9/1999 | Wörwag | |
| 6,099,661 | A | 8/2000 | Conrad | |
| 6,151,752 | A | 11/2000 | Melzner et al. | |
| 6,502,279 | B2 * | 1/2003 | Marazzi et al. | 15/387 |
| 6,615,445 | B2 | 9/2003 | Wörwag | |
| 6,813,809 | B2 * | 11/2004 | Worwag | 15/387 |
| 7,441,307 | B2 | 10/2008 | Smith | |
| 7,941,893 | B2 * | 5/2011 | Worwag | 15/319 |
| 2005/0251953 | A1 | 11/2005 | Hackwell et al. | |
| 2006/0162119 | A1 | 7/2006 | Smith | |
| 2012/0144621 | A1 | 6/2012 | Forbes et al. | |
| 2013/0139349 | A1 * | 6/2013 | Iles et al. | 15/383 |

FOREIGN PATENT DOCUMENTS

| | | |
|---|---|---|
| DE | 296 21 116 | 3/1997 |
| DE | 198 26 041 | 11/1999 |
| DE | 100 42 669 | 2/2001 |
| EP | 0 564 222 | 10/1993 |
| GB | 2 252 900 | 8/1992 |
| GB | 2 253 780 | 9/1992 |
| GB | 2 264 225 | 8/1993 |
| GB | 2 322 291 | 8/1998 |
| GB | 2478384 | 9/2011 |
| JP | 61-280828 | 12/1986 |
| JP | 01-221128 | 9/1989 |
| JP | 01-223920 | 9/1989 |
| JP | 5-317213 | 12/1993 |
| JP | 8-187208 | 7/1996 |
| JP | 9-23998 | 1/1997 |
| JP | 10-286202 | 10/1998 |
| JP | 10-328092 | 12/1998 |
| JP | 11-9523 | 1/1999 |
| JP | 2003-21385 | 1/2003 |
| WO | WO-99/65376 | 12/1999 |

OTHER PUBLICATIONS

Notice of Reasons for Rejection mailed Jan. 15, 2008, directed to Japanese Application No. JP-2004-539183; 5 pages.

Smith, D. B., U.S. Office Action mailed Nov. 14, 2007, directed to U.S. Appl. No. 10/528,790; 6 pages.

Smith, D. B., U.S. Office Action mailed Dec. 20, 2007, directed to U.S. Appl. No. 10/528,790; 9 pages.

Smith, D. B., U.S. Office Action mailed Apr. 10, 2008, directed to U.S. Appl. No. 10/528,790; 6 pages.

Hackwell et al., U.S. Office Action mailed Jun. 17, 2008, directed to U.S. Appl. No. 10/528,804; 11 pages.

Hackwell et al., U.S. Office Action mailed Jan. 12, 2009, directed to U.S. Appl. No. 10/528,804; 16 pages.

Hackwell et al., U.S. Office Action mailed Sep. 30, 2009, directed to U.S. Appl. No. 10/528,804; 14 pages.

Hackwell et al., U.S. Office Action mailed Mar. 22, 2010, directed to U.S. Appl. No. 10/528,804; 14 pages.

Search Report mailed Dec. 7, 2012, directed to GB Application No. 1214420.0; 2 pages.

* cited by examiner

CLEANER HEAD FOR A VACUUM CLEANER

REFERENCE TO RELATED APPLICATIONS

This application claims the priority of United Kingdom Application No. 1214420.0, filed Aug. 13, 2012, the entire contents of which are incorporated herein by reference.

FIELD OF THE INVENTION

The present invention relates to a cleaner head for a vacuum cleaner.

BACKGROUND OF THE INVENTION

The cleaner head of a vacuum cleaner typically comprises an agitator driven by a drive assembly. The drive assembly may include a turbine for generating the torque necessary to drive the agitator. The turbine may be driven by dirty air that is drawn in through the main suction inlet. Alternatively, the turbine may be driven by clean air that is drawn in through an inlet distinct from the suction inlet.

A clean-air turbine has the advantage that the turbine is not exposed to the dirty air, which might otherwise obstruct the turbine. However, should the path carrying the dirty air become obstructed, the flow of clean air through the turbine will increase. As a result, the speed of the turbine will increase. The increase in speed may be several orders of magnitude greater than the normal operating speed of the turbine. As a result, components of the drive assembly, such as bearings, may be damaged.

Schemes for preventing overspeed of a clean-air turbine are known. However, such schemes tend to be complicated, thereby increasing the cost, size and/or weight of the cleaner head.

SUMMARY OF THE INVENTION

The present invention provides a cleaner head for a vacuum cleaner comprising a suction inlet for admitting a first airflow, a turbine inlet for admitting a second airflow, an outlet for discharging the first airflow and the second airflow, a first airflow path for carrying the first airflow from the suction inlet to the outlet, a second airflow path for carrying the second airflow from the turbine inlet to the outlet, an agitator for agitating a surface to be cleaned, a drive assembly for driving the agitator, the drive assembly comprising a turbine that is driven by the second airflow, and a baffle located in the second airflow path and movable between an open position in which the second airflow path is unrestricted and a closed position in which the second airflow path is restricted, wherein the baffle is biased in the open position, the second airflow exerts a lift force on the baffle when in the open position, and the baffle moves to the closed position when the dynamic pressure of the second airflow at the baffle exceeds a threshold.

The baffle therefore closes automatically when the dynamic pressure of the second airflow exceeds a threshold. The baffle closes so as to restrict the second airflow path, thereby reducing the mass flow rate of the second airflow. Since the second airflow is responsible for driving the turbine, overspeed of the drive assembly may be avoided. In comparison to existing schemes for preventing overspeed, the baffle is less complex, cheaper to implement and lighter. Moreover, since the baffle is located within the second airflow path, overspeed protection may be achieved without increasing the size of the cleaner head.

The baffle may restrict the second airflow path completely such that, other than incidental leaks, the second airflow is prevented from flowing from the turbine inlet to the outlet. As a result, the drive assembly and the agitator are stopped. Alternatively, the baffle may restrict the second airflow path partially such that the second airflow continues to flow from the turbine inlet to the outlet. The mass flow rate of the second airflow may be sufficient to drive the drive assembly and the agitator. However, in restricting partially the second airflow path, the mass flow rate is reduced such that overspeed of the drive assembly may be avoided.

The baffle may be biased in the open position by a biasing force, such as that provided by a spring or an elastic tether. The baffle then moves to the closed position when the lift force exerted by the second airflow exceeds the biasing force.

When in the closed position, the baffle may restrict the second airflow path such that the mass flow rate of the second flow is insufficient to drive the drive assembly and the agitator. This then has the benefit that, when a blockage occurs within the first airflow path, a user is provided with a clear indication (namely the stopping of the agitator) that a blockage has occurred.

The baffle may be coupled to a user-operable actuator, such as a dial or knob. A user is then able to move the baffle between the open and closed positions, irrespective of the dynamic pressure of the second airflow. Where the baffle restricts completely the second airflow path, the user-operable actuator may be used to turn off and on the agitator. Alternatively, where the baffle restricts partially the second airflow path, the user-operable actuator may be used to switch between two different power settings for the agitator.

The first airflow and the second airflow are generated in response to suction at the outlet. The baffle may be configured such that, when in the closed position, the suction retains the baffle in the closed position, and the baffle returns to the open position when the suction is removed. This then has the benefit that, when employed with a vacuum cleaner, the baffle remains closed until such time as the vacuum cleaner is turned off or the cleaner head is detached from the vacuum cleaner. The cleaner head is intended primarily to be used with the agitator turned on (when the baffle restricts completely the second airflow path) or in high-power mode (when the baffle restricts partially the second airflow path). By ensuring that the baffle returns to the open position once the suction is removed, the agitator is again turned on or returned to the high-power mode when the vacuum cleaner is later turned on or the floor tool is later reattached to the vacuum cleaner.

When the baffle moves to the closed position, one or more small gaps may exist between the baffle and a wall of the second airflow path. As the second airflow is drawn through these gaps, unwanted noise or vibration may be generated. The baffle may therefore comprise a flexible seal that deforms to create a seal within the second airflow path when in the closed position. As a result, such gaps may be avoided or minimised.

The baffle may comprise a body to which the seal is attached. The body is then made of a stiffer material than that of the seal. For example, the body may be formed of a thermoplastic, whilst the seal may be formed of natural or synthetic rubber which is overmoulded onto the body. During use, suction at the outlet is intended to retain the baffle in the closed position. If the baffle were formed only of a compliant material, the baffle would most likely deform when in the closed position. By having a baffle that comprises a stiff body and a flexible seal, the baffle is able to both retain its position when in the closed position and deform to create a seal within the second airflow path.

The baffle may lie generally parallel to a wall of the second airflow path when in the open position and normal to the wall when in the closed position. As a result, a relatively compact arrangement may be achieved. By lying parallel to the wall, the baffle does not interfere adversely with the second airflow when the baffle is in the open position.

The present invention also provides a cleaner head for a vacuum cleaner comprising a suction inlet for admitting a first airflow, a turbine inlet for admitting a second airflow, an outlet for discharging the first airflow and the second airflow, a first airflow path for carrying the first airflow from the suction inlet to the outlet, a second airflow path for carrying the second airflow from the turbine inlet to the outlet, an agitator for agitating a surface to be cleaned, a drive assembly for driving the agitator, the drive assembly comprising a turbine that is driven by the second airflow, and a baffle located in the second airflow path and movable between an open position in which the second airflow path is unrestricted and a closed position in which the second airflow path is restricted, wherein the first airflow and the second airflow are generated in response to suction at the outlet, the baffle is biased in the open position, the second airflow exerts a lift force on the baffle when in the open position, the baffle moves to the closed position when the dynamic pressure of the second airflow at the baffle exceeds a threshold, the suction subsequently retains the baffle in the closed position, and the baffle returns to the open position when the suction is removed.

The baffle therefore closes automatically when the dynamic pressure of the second airflow exceeds a threshold. The baffle closes so as to restrict the second airflow path, thereby reducing the mass flow rate of the second airflow. Since the second airflow is responsible for driving the turbine, overspeed of the drive assembly may be avoided.

The first airflow and the second airflow are generated in response to suction at the outlet. When the baffle closes, the suction retains the baffle in the closed position. The baffle then returns to the open position when the suction is removed. This then has the benefit that, when employed with a vacuum cleaner, the baffle remains closed until such time as the vacuum cleaner is turned off or the cleaner head is detached from the vacuum cleaner. The cleaner head is intended primarily to be used with the agitator turned on (when the baffle restricts completely the second airflow path) or in high-power mode (when the baffle restricts partially the second airflow path). By ensuring that the baffle returns to the open position once the suction is removed, the agitator is again turned on or returned to the high-power mode when the vacuum cleaner is later turned on or the floor tool is later reattached to the vacuum cleaner.

The present invention further provides a cleaner head for a vacuum cleaner comprising a suction inlet for admitting a first airflow, a turbine inlet for admitting a second airflow, an outlet for discharging the first airflow and the second airflow, a first airflow path for carrying the first airflow from the suction inlet to the outlet, a second airflow path for carrying the second airflow from the turbine inlet to the outlet, an agitator for agitating a surface to be cleaned, a drive assembly for driving the agitator, the drive assembly comprising a turbine that is driven by the second airflow, a baffle located in the second airflow path and movable between an open position in which the second airflow path is unrestricted and a closed position in which the second airflow path is restricted, and a user-operable actuator coupled to the baffle such that a user may move the baffle between the open and closed positions, wherein the baffle is biased in the open position, the second airflow exerts a lift force on the baffle when in the open position, and the baffle moves to the closed position when the dynamic pressure of the second airflow at the baffle exceeds a threshold.

The baffle therefore closes automatically when the dynamic pressure of the second airflow exceeds a threshold. The baffle closes so as to restrict the second airflow path, thereby reducing the mass flow rate of the second airflow. Since the second airflow is responsible for driving the turbine, overspeed of the drive assembly may be avoided.

The baffle may additionally be moved between the open and closed positions using the user-operable actuator. The baffle may restrict completely the second airflow path. In this instance, the user-operable actuator may be used to turn off and on the agitator.

Alternatively, the baffle may restrict partially the second airflow path. In this instance, the user-operable actuator may be used to switch between two different power settings for the agitator.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
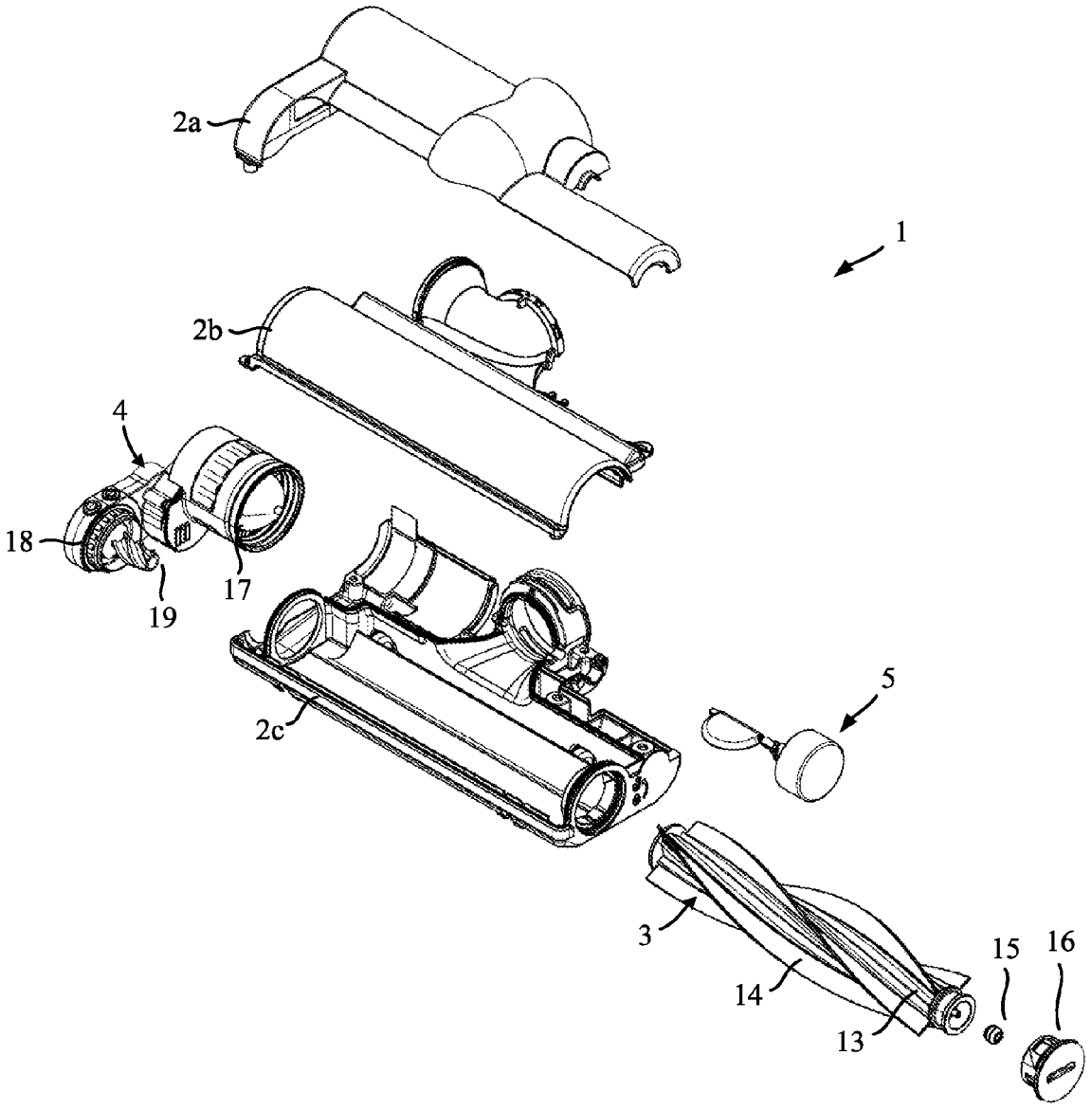
FIG. 1 is an exploded view of a cleaner head in accordance with the present invention.
Figure 2:
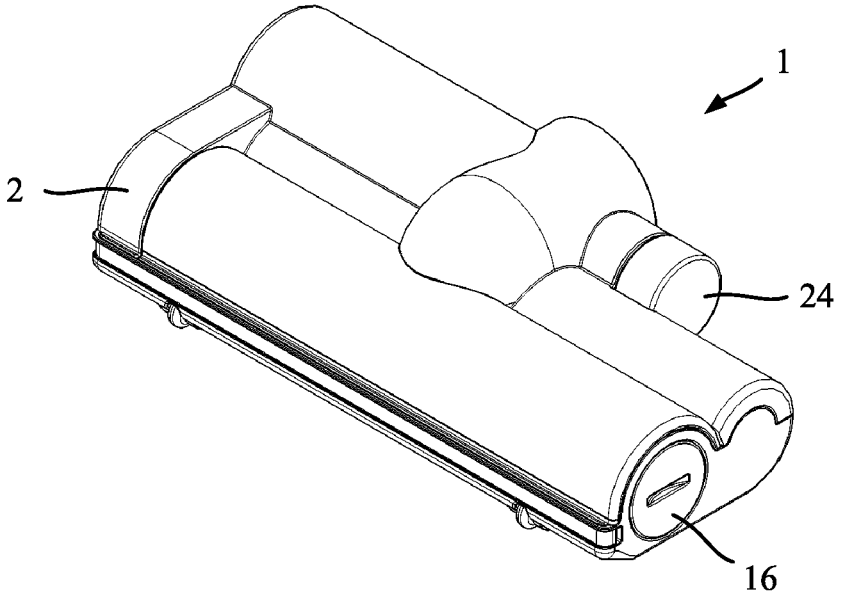
FIG. 2 is an isometric view from above of the cleaner head.
Figure 3:
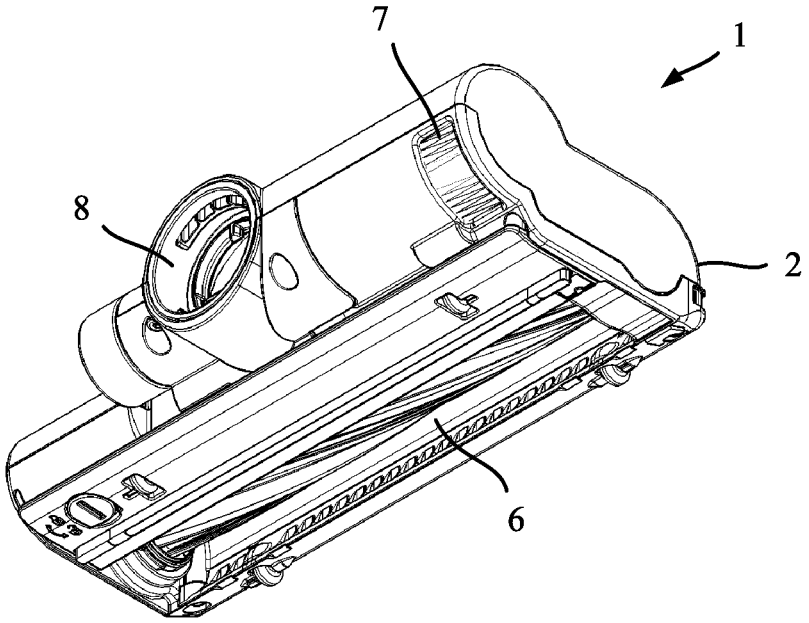
FIG. 3 is an isometric view from below of the cleaner head.
Figure 4:
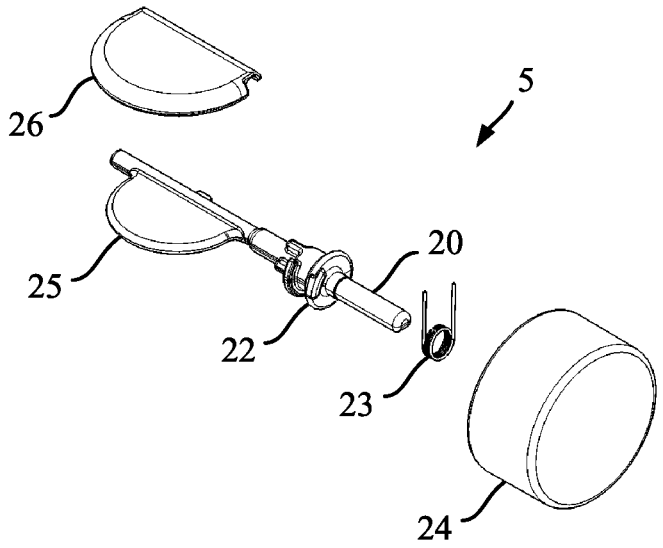
FIG. 4 is an exploded view of a drive-control mechanism of the cleaner head.
Figure 5:
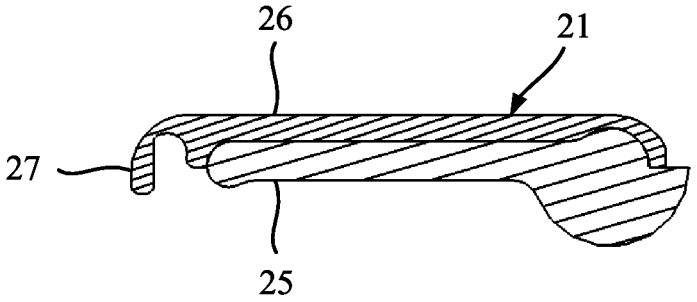
FIG. 5 is a sectional slice through the baffle of the drive-control mechanism.
Figure 6:
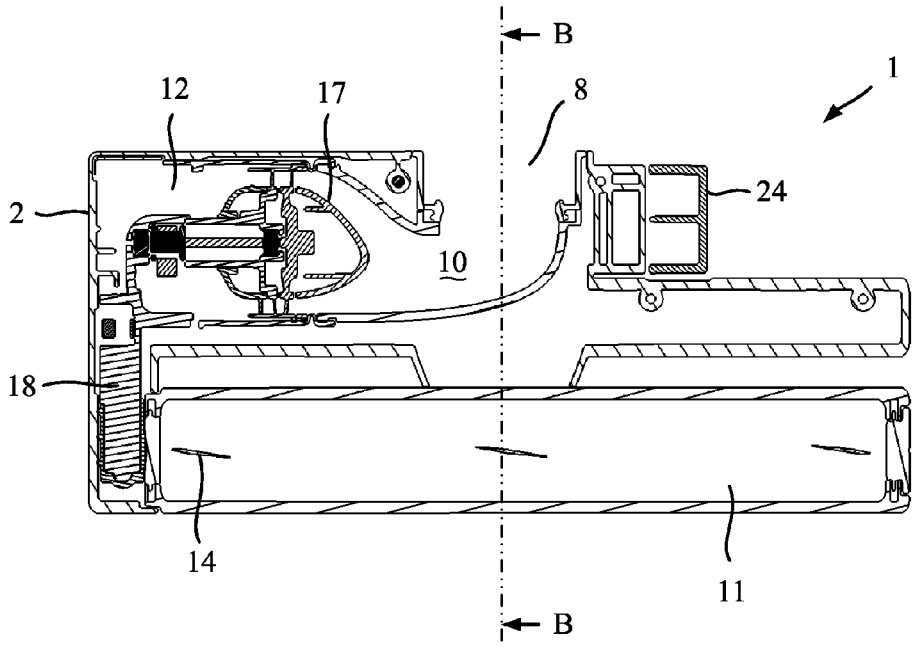
FIG. 6 is a sectional slice through the cleaner head along the plane A-A.

The cleaner head 1 of FIGS. 1 to 8 comprises a housing 2, an agitator 3, a drive assembly 4, and a drive-control mechanism 5.

The housing 2 comprises several different sections 2*a*-2*c* that, when assembled, define a suction inlet 6, a turbine inlet 7, an outlet 8, a first airflow path 9 for carrying a first airflow from the suction inlet 6 to the outlet 8, and a second airflow 10 path for carrying a second airflow from the turbine inlet 7 to the outlet 8

The suction inlet 6 is formed on an underside of the housing 2. During use, dirty air is drawn in through the suction inlet 6 and carried by the first airflow path 9 to the outlet 8.

The turbine inlet 7 is formed at the rear of the housing 4. Owing to its location, clean air rather than dirty air is drawn in through the turbine inlet 7 during operation. From there, the clean air is carried by the second airflow path 10 to the outlet 8.

The first and second airflow paths 9,10 are defined by walls of the housing 2. The first airflow path 9 comprises an agitator chamber 11, and the second airflow path 10 comprises a turbine chamber 12. The two airflow paths 9,10 merge at the outlet 8, which is located at the rear of the housing 2.

The agitator 3 comprises an elongate body 13 to which bristles, flicker strips or other means 14 for agitating a cleaning surface are attached. The agitator 3 is rotatably mounted with the agitator chamber 11. More specifically, the agitator 3 is mounted at one end to a bushing 15 seated within a removable cap 16. The opposite end of the agitator 3 is mounted to a dog 19 forming part of the drive assembly 4.

The drive assembly 4 comprises a turbine 17 and a transmission 18 for transmitting torque generated by the turbine 17 to the agitator 3. The transmission 18 comprises, among other things, a dog 19 to which one end of the agitator 3 is mounted. The turbine 17 is mounted within the turbine chamber 12 and is driven by the second airflow. The details of the drive assembly 4 are not pertinent to the present invention, and drive assemblies suitable for use in the present cleaner head 2 are well known. By way of example, the cleaner head of the DC12 vacuum cleaner sold by Dyson Limited, and the mini turbine head sold by Dyson Limited as an accessory for removing pet hair, each include a drive assembly suitable for inclusion in the present cleaner head 2.

The drive-control mechanism 7 comprises a shaft 20, a baffle 21, a retainer 22, a torsion spring 23, and a user-operable actuator 24.

The baffle 21 is semi-circular in shape and is attached to the shaft 20 along its straight edge. The baffle 21 comprises a body 25 formed of a relatively stiff material over which a cover 26 of a more compliant material is moulded. The cover 26 projects beyond the body 25 so as to define a flexible seal 27.

The retainer 22 comprises a disc-shaped body having a hook on one side. The retainer 22 is attached to and projects radially outward from the shaft 20.

The spring 23 is mounted to the shaft 20 at the retainer 22. Moreover, one arm of the spring 23 is retained by the hook of the retainer 22.

The user-operable actuator 24 comprises a cylindrical dial attached to one end of the shaft 20. Turning the actuator 24 thus causes the shaft 20 to rotate about its axis.

The shaft 20, the body 25 of the baffle 21, and the retainer 22 are formed as a single moulded component. This then simplifies the manufacture of the drive-control mechanism 5. Equally, however, the various parts may be formed separately and then attached to one another.

With the exception of the user-operable actuator 24 and that part of the shaft 20 attached to the actuator 24, the drive-control mechanism 5 is located within the housing 2.

The retainer 22 is seated within a recess in the housing 2. As noted above, one arm of the spring 23 is retained by the retainer 22. The other arm of the spring 23 is retained by the housing 2. Consequently, as the shaft 20 rotates, the spring 23 is twisted and exerts a biasing force in the opposite direction.

Figure 7:
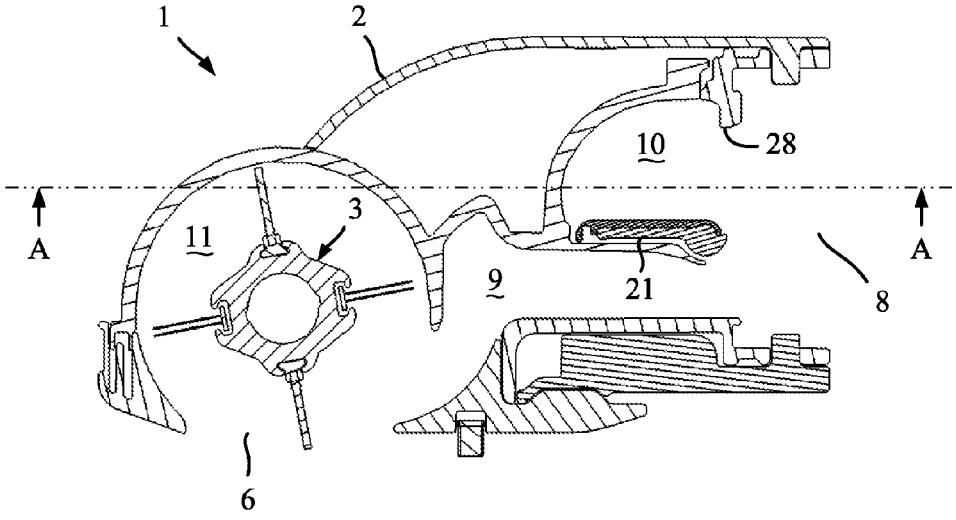
FIG. 7 is a sectional slice through the cleaner head along the plane B-B, wherein the baffle of the drive-control mechanism is in an open position.
Figure 8:
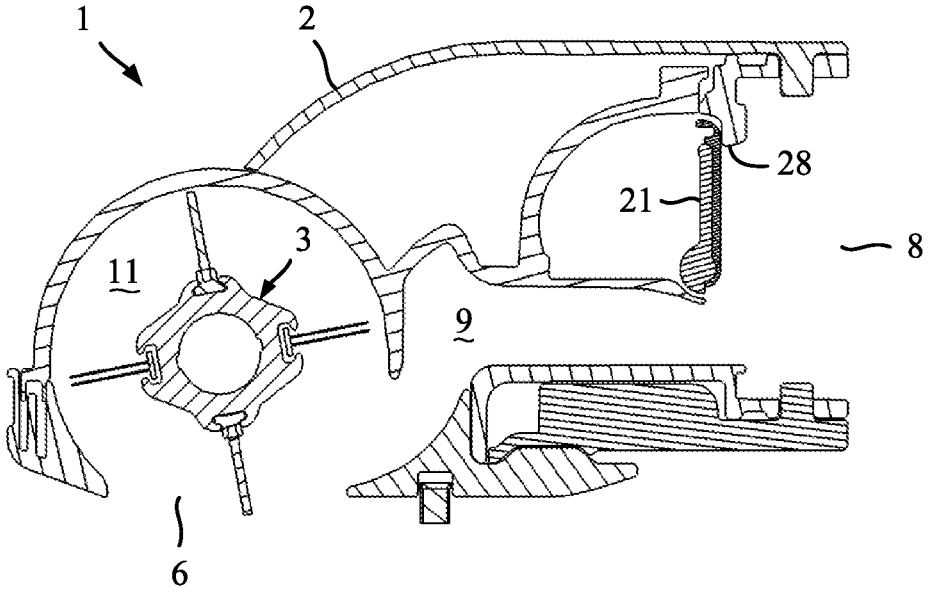
FIG. 8 is a sectional slice through the cleaner head in the plane B-B, wherein the baffle of the drive-control mechanism is in a closed position.

The baffle 21 is located within the second airflow path 10 at a position downstream of the turbine chamber 12 and upstream of the outlet 8. The baffle 21 is movable between an open position and a closed position. In the open position, as shown in FIG. 7, the baffle 21 lies flat against a wall of the second airflow path. In the closed position, as shown in FIG. 8, the baffle 21 lies normal to the wall. The baffle 21 is shaped and sized such that, when in the closed position, the baffle 21 closes the second airflow path 10. In the present embodiment, the cross-sectional shape of the second airflow path 10 at the baffle 21 is generally semi-circular, hence the shape of the baffle 21. The wall of the second airflow path 10 includes a small stub 28 against which the baffle 21 abuts when in the closed position. The stub 28 prevents the baffle 21 from moving beyond the closed position, as is explained below in more detail.

Turning the user-operable actuator 24 causes the baffle 21 to move between the open position and the closed position. The actuator 24 may therefore be regarded as having an ON position in which the baffle 21 is in the open position, and an OFF position in which the baffle 21 is in the closed position. Owing to the biasing force of the torsion spring 23, the actuator 24 is biased in the ON position.

The cleaner head 1 is intended to form part of a vacuum cleaner. For example, the cleaner head 1 may form the primary cleaner head of the vacuum cleaner. Alternatively, the cleaner head 1 form of an accessory that is intended to be attached to a wand, hose or the like of the vacuum cleaner.

During use, the vacuum cleaner generates suction at the outlet 8 of the cleaner head 1. The suction causes a first airflow to be drawn in through the suction inlet 6, and a second airflow to be drawn in through the turbine inlet 7. The first airflow is carried by the first airflow path 9 to the outlet 8, and the second airflow is carried by the second airflow path 10 to the outlet 8.

The turbine 17, which is located in the second airflow path 10, is driven by the second airflow. The torque generated by the turbine 17 is transmitted to the agitator 3 by the transmission 18. As the agitator 3 rotates, the bristles or other means 14 project beyond the suction inlet 6 and agitate the cleaning surface. The agitation encourages dirt to be lifted from the cleaning surface, whereupon the dirt is drawn in through the suction inlet 6. The first airflow path 9 is therefore intended to carry dirty air, whereas the second airflow path 10 is intended to carry clean air. In order that dirt is prevented from being carried inadvertently by the second airflow, the turbine inlet 7 may be covered by a fine mesh or other screen.

The baffle 21 is biased in the open position by the torsion spring 23. When in the open position, the second airflow path 10 is open and thus the second airflow is free to flow from the turbine inlet 7 to the outlet 8. As a result, the turbine 17 is driven by the second airflow and thus the agitator 3 is caused to rotate.

Rotation of the agitator 3 may be stopped by turning the user-operable actuator 24 from the ON position to the OFF position. Turning the actuator 24 to the OFF position causes the baffle 21 to move from the open position to the closed position. When the baffle 21 is in the closed position, the second airflow path 10 is closed and thus the second airflow is prevented from flowing from the turbine inlet 7 to the outlet 8. As a result, the turbine 17 and thus the agitator 3 stop rotating.

When the baffle 21 is in the closed position, the suction generated by the vacuum cleaner creates a partial vacuum on one side of the baffle 21. The opposite side of the baffle 21, on the other hand, is at ambient. As a result, there is a net force that exceeds the biasing force of the spring 23 and maintains the baffle 21 in the closed position. The baffle 21 is returned to the open position in one of two ways. First, the user-operable actuator 24 may be turned to the ON position. The actuator 24 may therefore be used to turn the agitator 3 both off and on. Second, the suction generated by the vacuum cleaner may be removed from the cleaner head 1, e.g. by turning off the vacuum cleaner or by detaching the cleaner head 1 from the vacuum cleaner. As a result, the baffle 21 returns to the open position under the biasing force of the spring 23. The cleaner head 1 is intended to be used primarily with the agitator 3 turned on. Ensuring that the baffle 21 returns to the open position once the suction is removed has the benefit that, when the vacuum cleaner is subsequently turned on or the cleaner head 1 is subsequently reattached to the vacuum cleaner, the agitator 3 is already turned on.

During use, the first airflow path 9 may become obstructed, e.g. by dirt or some other object inadvertently drawn in through the suction inlet 6. The obstruction may lead to a decrease in the mass flow rate of the first airflow. Since the suction at the outlet 8 is generally unchanged, the mass flow rate of the second airflow increases. As a result, the speed of the turbine 17 increases. Overspeed of the turbine 17 may damage components of the drive assembly 4, such as bearings. However, as will now be explained, the baffle 21 moves automatically to the closed position whenever the mass flow rate of the second airflow reaches a level that would otherwise result in overspeed.

When the baffle 21 is in the open position, the second airflow exerts a lift force on the baffle 21. When the mass flow rate of the second airflow lies within normal operating limits, the biasing force of the spring 23 exceeds the lift force of the second airflow. Consequently, the baffle 21 is held in the open position during normal use of the cleaner head 1. When an obstruction occurs in the first airflow path 9, the mass flow rate of the second airflow increases. As a result, the dynamic pressure of the second airflow at the baffle 21 increases and thus the lift force exerted by the second airflow on the baffle 21 increases. When the dynamic pressure at the baffle 21 exceeds a threshold, the lift force exceeds the biasing force of the spring 23 and the baffle 21 moves to the closed position. The baffle 21 therefore moves automatically to the closed position whenever the mass flow rate of the second airflow reaches a level that would otherwise result in overspeed of the drive assembly 4.

When the baffle 21 moves automatically to the closed position, the agitator 3 stops rotating. A user is therefore provided with an indication that an obstruction has occurred in the first airflow path. This is particularly useful since any obstruction is likely to compromise the cleaning performance of the cleaner head 1. Without the baffle 21, a user would not necessary know that an obstruction had occurred. This is particularly true since the agitator 3 would continue to rotate.

When an obstruction occurs, the user may attempt to clear the obstruction whilst the vacuum cleaner is turned on and continues to apply suction at the outlet 8. As noted above, the suction generated at the outlet 8 maintains the baffle 21 in the closed position. Accordingly, on clearing the obstruction, the agitator 3 remains stationary. Potential harm to the user (e.g. the hand used to remove the obstruction) is therefore avoided.

As noted above, the baffle 21 moves to the closed position whenever the dynamic pressure of the second airflow at the baffle 21 exceeds a threshold. Several factors influence the magnitude of this threshold. Chief among them are the cross-sectional area of the second airflow path 10, the spring constant of the torsion spring 23, the mass of the baffle 21, and the lift coefficient of the baffle 21. The lift coefficient is determined by, among other things, the shape and angle of attack of the baffle 21. Adjusting any one of these factors will influence the dynamic-pressure threshold at which the baffle 21 moves to the closed position. So, for example, decreasing the spring constant of the torsion spring 23 will cause the baffle 21 to move to the closed position in response to a lower dynamic pressure and thus a lower mass flow rate.

When the baffle 21 is in the closed position, the baffle 21 abuts the stub 28 in the wall of the second airflow path 10. This then prevents the baffle 21 from moving beyond the closed position. Without the stub 28, the suction at the outlet 8 would cause the baffle 21 to move beyond the closed position. The second airflow would then continue to flow and thus overspeed protection of the turbine 17 would no longer be provided. In the present embodiment, the baffle 21 is stopped by a sub 28. However, other means for preventing travel of the baffle 21 beyond the closed position might equally be used. For example, the wall of the second airflow path 10 may include a ridge or the wall may narrow slightly. As a further alternative, the shaft 20 or the retainer 22 may include a feature that permits rotation through 90 degrees only.

The baffle 21 comprises a body 25 formed of a relatively stiff material over which a cover 26 of a more compliant material is formed. The cover 26 projects beyond the body 25 to create a flexible seal 27 at the periphery of the baffle 21. When in the closed position, the seal 27 deforms to form a seal against the wall of the second airflow path 10. As a result, potential leaks around the baffle 21, which might otherwise generate noise and/or vibration, may be avoided.

If the baffle 21 were made only of a compliant material, the baffle 21 would most likely deform under the suction of the vacuum cleaner when in the closed position. As a result, the second airflow would continue to flow past the baffle 21. Indeed, the baffle 21 may deform to such an extent that overspeed protection and/or manual on/off control is no longer provided. By having a baffle 21 that comprises a body 25 formed of a relatively stiff material, the baffle 21 has the necessary stiffness to ensure that the baffle 21 does not deform under the suction of the vacuum cleaner when in the closed position. The combination of a stiff body 25 and flexible seal 26 therefore ensures that the baffle 21 retains its position when in the closed position whilst deforming at the periphery to create a seal within the second airflow path 10.

In spite of the aforementioned advantages, the seal 27 is not regarded as essential since any leaks around the baffle 21 are unlikely to be sufficient to drive the drive assembly 4 and the agitator 3. Even if the drive assembly 4 and the agitator 3 were to rotate, the speed would be relatively slow. Moreover, any noise generated by leaks around the baffle 21 may actually serve to provide the user with a further indication that an obstruction has occurred in the first airflow path 9. Accordingly, the seal 27, and the cover 26 used to create the seal 27, may be omitted.

In the embodiment described above, the baffle 21 is sized and shaped such that, when in the closed position, the baffle 21 closes completely the second airflow path 10. Consequently, other than incidental leaks, the second airflow is prevented from flowing from the turbine inlet 7 to the outlet 8, and thus the drive assembly 4 and the agitator 3 are stopped. Conceivably, the baffle 21 may be sized and shaped such that the baffle 21 closes only partially the second airflow path 10. In this instance, the second airflow would continue to flow from the turbine inlet 7 to the outlet 8. Moreover, the mass flow rate of the second airflow may be sufficient to drive the drive assembly 4 and the agitator 3. However, in closing partially the second airflow path 10, the mass flow rate of the second airflow is reduced. As a result, overspeed of the drive assembly 4 may be avoided. Additionally, the user-operable actuator 24 may be used to switch between two different power settings for the drive assembly 4 and the agitator 3. For example, when the baffle 21 is in the open position, the second airflow has a higher mass flow rate and thus the drive assembly 4 and the agitator 3 are driven at higher power. In contrast, when the baffle 21 is in the closed position, the second airflow has a lower mass flow rate and thus the drive assembly 4 and the agitator 3 are driven at lower power. Since the baffle 21 may be configured to partially or fully close the second airflow path 10, the second airflow path 10 may be said to be restricted (e.g. partially or fully closed) when the baffle 21 is in the closed position and unrestricted (e.g. open) when the baffle 21 is in the open position.

The drive-control mechanism 5 provides two functions. First, it provides a user with the means to control the agitator 3. In particular, the actuator 24 may be used to turn the agitator 3 off and on, or switch between different power settings. Second, it provides overspeed protection of the drive assembly 4 by automatically restricting the second airflow path 10 in response to an excessive mass flow rate. Conceivably, the user-operable actuator 24 may be omitted such that the drive-control mechanism 5 provides overspeed protection only. Additionally, the shaft 20 and retainer 22 may be omitted and the baffle 21 may be directly attached to the housing 2. For example, the baffle 21 may include a pin at each end of the straight edge which is held by the housing 2 such that the baffle 21 is free to pivot within the second airflow path 10. Accordingly, in its most simplest sense, the drive-control mechanism 5 may be regarded as a baffle 21 located within the second airflow path 10, which is movable between an open position in which the second airflow path 10 is unrestricted (e.g. open) and a closed position in which the second airflow path 10 is restricted (e.g. partially or fully closed). The baffle 21 is then biased (e.g. by means of a spring, elastic tether or other means) in the open position and moves to the closed position when the dynamic pressure of the second airflow at the baffle 21 exceeds a threshold.

In the embodiment described above, the user-operable actuator 24 comprises a dial that is coupled to the baffle 21 by means of a shaft 20. However, the actuator 24 may comprise alternative means (e.g. knob, lever or the like) which, when coupled to the baffle 21, can be operated by a user in order to move the baffle 21 from the open position to the closed position.

The agitator 3 of the above embodiment comprises an elongate body 13 having bristles, flicker strips or other means 14 for agitating the cleaning surface. This type of agitator is generally referred to as a brush bar or beater bar. However, alternative types of agitator capable of being driven by the drive assembly 4 might equally be used. By way of example, the agitator 3 may comprise a pair of rotary discs, as described in US2012/0144621.

The present invention provides a relatively simple mechanism 5 for protecting against overspeed of the drive assembly 4. In comparison to existing mechanisms, the baffle 21 is relatively cheap and lightweight. Moreover, since the baffle 21 is located within the path 10 used to carry the airflow for driving the drive assembly 4, overspeed protection may be achieved without increasing the size of the cleaner head 1.

The invention claimed is:

1. A cleaner head for a vacuum cleaner comprising:
- a suction inlet for admitting a first airflow;
- a turbine inlet for admitting a second airflow;
- an outlet for discharging the first airflow and the second airflow;
- a first airflow path for carrying the first airflow from the suction inlet to the outlet;
- a second airflow path for carrying the second airflow from the turbine inlet to the outlet;
- an agitator for agitating a surface to be cleaned;
- a drive assembly for driving the agitator, the drive assembly comprising a turbine that is driven by the second airflow; and
- a baffle located in the second airflow path and movable between an open position in which the second airflow path is unrestricted and a closed position in which the second airflow path is restricted, wherein the baffle is biased in the open position, the second airflow exerts a lift force on the baffle when in the open position, and the baffle moves to the closed position when the dynamic pressure of the second airflow at the baffle exceeds a threshold.

2. The cleaner head of claim 1, wherein the baffle is biased in the open position by a biasing force, and the baffle moves to the closed position when the lift force exceeds the biasing force.

3. The cleaner head of claim 1, wherein the baffle restricts the second airflow path such that the mass flow rate of the second airflow is insufficient to drive the drive assembly and the agitator.

4. The cleaner head of claim 1, wherein the baffle is coupled to a user-operable actuator such that a user may move the baffle between the open and closed positions.

5. The cleaner head of claim 1, wherein the first airflow and the second airflow are generated in response to suction at the outlet, and the baffle is configured such that the suction retains the baffle in the closed position, and the baffle returns to the open position when the suction is removed.

6. The cleaner head of claim 1, wherein the baffle comprises a flexible seal that deforms to create a seal within the second airflow path when the baffle is in the closed position.

7. The cleaner head of claim 6, wherein the baffle comprises a body to which the seal is attached, the body being formed of a stiffer material than that of the seal.

8. The cleaner head of claim 1, wherein the baffle lies generally parallel to a wall of the second airflow path when in the open position, and the baffle lies generally normal to the wall when in the closed position.

9. A cleaner head for a vacuum cleaner comprising:
- a suction inlet for admitting a first airflow;
- a turbine inlet for admitting a second airflow;
- an outlet for discharging the first airflow and the second airflow;
- a first airflow path for carrying the first airflow from the suction inlet to the outlet;
- a second airflow path for carrying the second airflow from the turbine inlet to the outlet;
- an agitator for agitating a surface to be cleaned;
- a drive assembly for driving the agitator, the drive assembly comprising a turbine that is driven by the second airflow; and
- a baffle located in the second airflow path and movable between an open position in which the second airflow path is unrestricted and a closed position in which the second airflow path is restricted, wherein the first airflow and the second airflow are generated in response to suction at the outlet, the baffle is biased in the open position, the second airflow exerts a lift force on the baffle when in the open position, the baffle moves to the closed position when the dynamic pressure of the second airflow at the baffle exceeds a threshold, the suction subsequently retains the baffle in the closed position, and the baffle returns to the open position when the suction is removed.

10. The cleaner head of claim 9, wherein the baffle is biased in the open position by a biasing force, and the baffle moves to the closed position when the lift force exceeds the biasing force.

11. The cleaner head of claim 9, wherein the baffle restricts the second airflow path such that the mass flow rate of the second airflow is insufficient to drive the drive assembly and the agitator.

12. The cleaner head of claim 9, wherein the baffle is coupled to a user-operable actuator such that a user may move the baffle between the open and closed positions.

13. The cleaner head of claim 9, wherein the baffle lies generally parallel to a wall of the second airflow path when in the open position, and the baffle lies generally normal to the wall when in the closed position.

14. A cleaner head for a vacuum cleaner comprising:

a suction inlet for admitting a first airflow;

a turbine inlet for admitting a second airflow;

an outlet for discharging the first airflow and the second airflow;

a first airflow path for carrying the first airflow from the suction inlet to the outlet;

a second airflow path for carrying the second airflow from the turbine inlet to the outlet;

an agitator for agitating a surface to be cleaned;

a drive assembly for driving the agitator, the drive assembly comprising a turbine that is driven by the second airflow;

a baffle located in the second airflow path and movable between an open position in which the second airflow path is unrestricted and a closed position in which the second airflow path is restricted; and a user-operable actuator coupled to the baffle such that a user may move the baffle between the open and closed positions, wherein the baffle is biased in the open position, the second airflow exerts a lift force on the baffle when in the open position, and the baffle moves to the closed position when the dynamic pressure of the second airflow at the baffle exceeds a threshold.

15. The cleaner head of claim 14, wherein the baffle is biased in the open position by a biasing force, and the baffle moves to the closed position when the lift force exceeds the biasing force.

16. The cleaner head of claim 14, wherein the baffle restricts the second airflow path such that the mass flow rate of the second airflow is insufficient to drive the drive assembly and the agitator.

17. The cleaner head of claim 14, wherein the first airflow and the second airflow are generated in response to suction at the outlet, and the baffle is configured such that the suction retains the baffle in the closed position, and the baffle returns to the open position when the suction is removed.

18. The cleaner head of claim 14, wherein the baffle lies generally parallel to a wall of the second airflow path when in the open position, and the baffle lies generally normal to the wall when in the closed position.

* * * * *